US010128095B2

(12) United States Patent
Freeman et al.

(10) Patent No.: US 10,128,095 B2
(45) Date of Patent: Nov. 13, 2018

(54) METHODS AND SYSTEMS OF TREATING A PARTICLE BEAM AND PERFORMING MASS SPECTROSCOPY

(71) Applicant: The University Court of the University of Glasgow, Glasgow (GB)

(72) Inventors: Stewart Freeman, East Kilbride (GB); Richard Shanks, East Kilbride (GB)

(73) Assignee: University Court of University of Glasgow, Glasgow (GB)

( * ) Notice: Subject to any disclaimer, the term of this patent is extended or adjusted under 35 U.S.C. 154(b) by 0 days.

(21) Appl. No.: 15/321,146

(22) PCT Filed: Jun. 26, 2015

(86) PCT No.: PCT/GB2015/051872
§ 371 (c)(1),
(2) Date: Dec. 21, 2016

(87) PCT Pub. No.: WO2015/198069
PCT Pub. Date: Dec. 30, 2015

(65) Prior Publication Data

US 2017/0154760 A1 Jun. 1, 2017

(30) Foreign Application Priority Data

Jun. 26, 2014 (GB) ..... 1411407.8

(51) Int. Cl.
*H01J 49/00* (2006.01)
*G21K 1/14* (2006.01)

(52) U.S. Cl.
CPC ..... *H01J 49/0086* (2013.01); *G21K 1/14* (2013.01)

(58) Field of Classification Search
CPC .... H01J 49/00; H01J 49/0009; H01J 49/0027; H01J 49/0086; H01J 49/02;
(Continued)

(56) References Cited

U.S. PATENT DOCUMENTS 2,816,243 A 12/1957 Herb et al.
3,136,908 A 6/1964 Weinman
(Continued)

FOREIGN PATENT DOCUMENTS

CA 2131942 A1 3/2014
WO WO-2015-198069 A1 12/2015

OTHER PUBLICATIONS

Wilcken et al., Positive Ion AMS with a Single-Stage Accelerator and an RF-Plasma Ion Source at SUERC, Nuclear Instruments and Methods in Physics Research B 266 (2008) pp. 2229-2232.*
(Continued)

*Primary Examiner* — Jason McCormack
(74) *Attorney, Agent, or Firm* — Swanson & Bratschun, L.L.C.

(57) ABSTRACT

A method of treating a particle beam is disclosed, of interest in particular for mass spectrometry for $^{14}C$. A particle beam including positive ions is passed through a charge exchange cell containing a target gas. The target gas is electrically insulating at room temperature and pressure. At least some of the positive ions of the particle beam are converted to negative ions by interaction with the target gas. The particle beam incident at the charge exchange cell includes molecules and/or molecular ions which interact with the target gas to reduce the concentration of molecules as a result of repeated collisions with particles of the target gas. A corresponding mass spectrometry system is also disclosed.

18 Claims, 4 Drawing Sheets

(58) Field of Classification Search
CPC .... H01J 49/0422; H01J 49/0431; H01J 49/06; H01J 49/10; H01J 49/105; H01J 49/107; H01J 49/126; H01J 49/145; H01J 49/147
USPC ..... 250/281, 282, 288
See application file for complete search history.

(56) References Cited

U.S. PATENT DOCUMENTS

| | | | | |
|---|---|---|---|---|
| 4,037,100 | A | 7/1977 | Purser | |
| 5,300,891 | A | 4/1994 | Nobuhiro | |
| 5,661,299 | A | 8/1997 | Purser | |
| 6,329,650 | B1 | 12/2001 | Dudnikov | |
| 6,455,844 | B1 * | 9/2002 | Meyer | B01D 59/48 250/281 |
| 6,815,666 | B2 | 11/2004 | Schroeder et al. | |
| 2002/0088944 | A1 | 7/2002 | LaFontaine et al. | |
| 2004/0046116 | A1 * | 3/2004 | Schroeder | H01J 49/0086 250/281 |
| 2013/0112869 | A1 * | 5/2013 | Synal | H01J 49/005 250/283 |

OTHER PUBLICATIONS

Hans-Arno Synal, Developments in accelerator mass spectrometry, International Journal of Mass Spectrometry 349-350 (2013) 192-202.
Walter Kutschera, Applications of accelerator mass spectrometry, International Journal of Mass Spectrometry 349-350 (2013) 203-218.
Stewart P.H.T. Freeman, Andrew Dougans, Lanny McHargue, Klaus M. Wilcken, Sheng Xu, Performance of the new single stage accelerator mass spectrometer at the SUERC, Nuclear Instruments and Methods in Physics Research B 266 (2008) 2225-2228.
Stewart P.H.T. Freeman, Gordon T. Cook, Andrew B. Dougans, Philip Naysmith, Klaus M. Wilcken, Sheng Xu, Improved SSAMS performance, Nuclear Instruments and Methods in Physics Research B 268 (2010) 715-717.
K.M. Wilcken, S.P.H.T. Freeman, S. Xu, A. Dougans, Positive ion AMS with a single-stage accelerator and an RF-plasma ion source at SUERC, Nuclear Instruments and Methods in Physics Research B 266 (2008) 2229-2232.
Sheng Xu, Andrew Dougan, Stewart P.H.T. Freeman, Colin Maden, Roger Loger, A gas ion source for radiocarbon measurement at SUERC, Nuclear Instruments and Methods in Physics Research B 259 (2007) 76-82.
Roy Middleton, On the possibility of counting 14C-ions without an accelerator, Proceedings of the First Conference on Radiocarbon Dating with Accelerators held at the University of Rochester Apr. 20 and 21, 1978 Edited by H. E. Gove, 157-164.
Ronald Schubank, A low-energy table-top approach to AMS, Nuclear Instruments and Methods in Physics Research B 172 (2000) 288-292.
Michael Hotchkis, Tao Wei, Radiocarbon detection by ion charge exchange mass spectrometry, Nuclear Instruments and Methods in Physics Research B 259 (2007) 158-164.
M.L. Robert, R.J. Schneider, K.F. von Reden, J.S.C. Wills, B.X. Han, J.M. Hayes, B.E. Rosenheim, W.J. Jenkins, Progress on a gas-accepting ion source for continuous-flow accelerator mass spectrometry, Nuclear Instruments and Methods in Physics Research B 259 (2007) 83-87.
K.M. Wilcken, S.P.H.T. Freeman, S. Xu, A. Dougans, Single-stage accelerator mass spectrometer radiocarbon-interference identification and positive-ionisation characterisation, Nuclear Instruments and Methods in Physics Research B 294 (2013) 353-355.
Jorgensen Jr et al, "Measurements on Charge-Changing Collisions Involving Negative Hydrogen, Helium and Oxygen Ions", Physical Review, vol. 140, No. 5a, Nov. 1965, pp. 1481-1487.
Windham et al, "Negative Helium Ions", Physical Review, vol. 109, No. 4, Feb. 1958, pp. 1193-1195.
Wilcken et al, "Attempted positive ion radiocarbon AMS", Nuclear Instruments & Methods in Physics Research, Section B: Beam Interactions with materials and atoms, vol. 268, No. 7-8, Apr. 2010, pp. 712-714.
Niklaus et al, "Progress report on the high-current ion source of the Zurich AMS facility", Nuclear Instruments & Methods in Physics Research, Section B: Beam Interactions with materials and atoms, vol. 92, No. 1/04, Jun. 1994, pp. 96-99.
Meyer et al, "LowEnergy Grazing IonScatterning From AlkaliHalide Suerface: A Novel Approach to C14 Detection", AIP Conference Proceedings 1099, 308 (2009); doi: 10.1063/1.3120038.

* cited by examiner

METHODS AND SYSTEMS OF TREATING A PARTICLE BEAM AND PERFORMING MASS SPECTROSCOPY

RELATED APPLICATIONS

This application is a 35 U.S.C. § 371 national phase application of PCT/GB2015/051872 (WO 2015/198069), filed on Jun. 26, 2015, entitled "Particle Beam Treatment" which application claims priority to United Kingdom Application No. 1411407.8, filed Jun. 26, 2014, which is incorporated herein by reference in its entirety.

BACKGROUND TO THE INVENTION

Field of the Invention

The present invention relates to a method of treating a particle beam and to an apparatus for treating a particle beam. The invention has particular applicability for changing the charge state of particles in the particle beam. The invention has applications in various fields such as in accelerator mass spectrometry (AMS). The present invention also relates to a method of performing mass spectrometry and to a system for performing mass spectrometry.

Related Art

Ultrasensitive mass spectrometry (analysis techniques for determining sample constituents) can require the suppression of relatively large interferences to the intended measurement. Radiocarbon-dating is important to archaeology and earth-sciences, and radiocarbon-tracer measurement is important to earth- and life-sciences (especially pharmacology). Carbon is 98.9% stable $^{12}C$, 1.1% stable $^{13}C$ and $10^{-12}$ (Modern) or less radioactive $^{14}C$; radiocarbon is anthropogenic and cosmogenic. Ubiquitous isobaric species such as $^{14}N$, $^{13}CH$ and $^{12}CH_2$ must typically be suppressed by many orders of magnitude to resolve $^{14}C$ by mass spectrometry. This is achieved in conventional accelerator mass spectrometry (AMS) by separately suppressing $^{14}N$ and the molecular species, as now explained. Firstly, atoms from the sample undergoing analysis are made negatively charged. As $N^-$ is only very short-lived, it is therefore removed. Subsequently the remaining ions, accelerated in a particle beam, with atomic/molecular mass 14 are collided with a 'stripper' that removes electrons and sufficiently breaks apart molecules prior to ion detection.

AMS is an ultrasensitive method of mass spectrometry which utilizes techniques well-known in nuclear physics, typically for the quantification of naturally extremely rare long-lived radionuclides in samples undergoing element isotope ratio analysis. The applications of AMS are manifold and at the time of writing it is performed at approximately 100 centres worldwide which possess the expertise to operate the particle accelerators required. Sample production and preparation for these instruments is carried out at many more institutions.

Synal (2013) (Hans-Arno Synal, Developments in accelerator mass spectrometry, International Journal of Mass Spectrometry 349-350 (2013) 192-202) and Kutschera (2013) (Walter Kutschera, Applications of accelerator mass spectrometry, International Journal of Mass Spectrometry 349-350 (2013) 203-218) are recent reviews of AMS.

As explained in detail in Synal (2013) known AMS typically involves converting the prepared-sample atoms into negative ions and passing these through two mass spectrometers separated by a target that fully transmits only atoms with high kinetic energy, and registering the resulting ions in a final particle detector.

For $^{14}C$ AMS, for example, two stages of analysis are required: the first is to separate the ions of $^{14}C$ from $^{14}N$ atomic isobar interference, and the second is to prevent interference from molecular isobars, e.g. $^{13}CH$ or $^{12}CH_2$. Conventionally, negative ions are produced and analysed with the first mass spectrometer to remove the $^{14}N$ interference, since $N^-$ ions produced unstable and therefore very short-lived. Molecular interference is overcome by subsequently colliding the negative ions with an inert gas or thin foil target and analysing the results with the second mass spectrometer and detector.

There are variations on this theme but in all cases the negative ions must be sufficiently energized to be pass through the solid or gas 'stripper' target. In some known systems, the ion-stripper interaction aims to remove sufficient electrons to result in a charge state of 3+ or more. This large positive charge cannot be sustained by interfering molecular species, so molecular interference to radiocarbon ion detection is reduced by selecting for such a charge state with the subsequent mass spectrometer. In this case the ion-stripper interaction stimulates molecules to spontaneously dissociate.

In more recent times, a method has been developed which is applicable at lower ion energies, involving the destruction of molecules directly by their interaction with the gas via repeated ion-gas molecule collision. This requires more stripper gas than then first case and this physics is called the 'thick'-stripper technique.

It is usual, but not essential for modest performance, to mount the stripper in the high-voltage terminal of an electrostatic particle accelerator as in U.S. Pat. No. 4,037,100, U.S. Pat. No. 5,661,299, and US2013/112869. Optionally the second mass spectrometer and particle detector can be accommodated in the terminal too, as described in U.S. Pat. No. 6,815,666.

SUMMARY OF THE INVENTION

The present inventors have realised that the instruments and methods discussed above suffer from the significant limitations, difficulties and costs of operating the negative-ion sources employed to convert the sample into an ion beam. Typically, most of a sample measurement cost is in making the material to be analysed compatible with the ion source technology. Sputter ion sources produce negative ions from an evolving condensed-matter sample surface resulting in varying beam emittance and relatively small $C^-$ ion beams from carbon samples introduced as $CO_2$ but larger beams when the $CO_2$ is first additionally converted to graphite with greater carbon atom density. Also, sample repeat measurements are typically interleaved with measurements of other samples and standards materials to compensate for the emittance changes, meaning that after a sample measurement the remaining sample material must be recovered from the ion source and stored pending re-measurement. Such negative ion sources typically operate on difficult-to-control Cs metallic vapour in order to achieve their best, but still low, sample ionisation efficiency.

In 1978, it was disclosed and appreciated that the usual AMS negative-to-positive atom charging arrangement might be reversed. This was disclosed in Middleton (1978) (see list of non-patent document references below for full details). The 3+ positive-to-negative alternative proposed by Middleton (1978) greatly reduced the need for a particle accelerator (beyond initial energization in the ion source to produce the ion beam) but the scheme first required ion source development. CA-A-2131942 specifies the use of an inductively coupled plasma ion source. In Hotchkis and Wei (2007) and Meyer et al (2009) (see also U.S. Pat. No. 6,455,844) measurement of radiocarbon-enriched materials is described using an electron cyclotron resonance (ECR) ion source combined, respectively, with negative ionisation in metallic vapour or by grazing incidence surface collision.

The use of an ECR ion source in Roberts et al. (2007) whereby positive ions are immediately charge-exchanged negative and then subsequently stripped positive again is actually an example of the conventional AMS scheme, but indicates the elaboration pursued to compensate for the problems of the more normal negative sputter-ion sources employed.

In Wilcken et al. (2010) and Wilcken et al. (2013) the previously-best but still insufficient measurement background for natural carbon analysis was achieved by using a thin solid membrane for negative ionisation.

The present inventors have realised that thick-stripper physics also produces a useful amount of negative ions so that known metal vapour charge exchange cells can be improved upon whilst addressing several practical disadvantages of known metal vapour charge exchange cells, identified by the inventors. It has surprisingly been found that the adoption of thick-stripper physics and benign gases makes charge exchange cells additionally effective molecule suppressors without compromising negative ionisation efficiency at the level of suppression achieved. Furthermore, the creation, containment and metering of metal vapours is cumbersome, imprecise and difficult, typically requiring specialist equipment. Still further, metal vapours are electrically conducting if condensed and so pose a challenge when used in systems involving high electric fields such as mass spectrometers.

The present invention has been devised in order to address at least one of the above problems. Preferably, the present invention reduces, ameliorates, avoids or overcomes at least one of the above problems.

Accordingly, in a first preferred aspect, the present invention provides a method of treating a particle beam, the particle beam including positive ions, including the step of passing the particle beam through a charge exchange cell, the charge exchange cell containing a gaseous target material, the target material being a material that is electrically insulating at room temperature and pressure, at least some of the positive ions of the particle beam being converted to negative ions by interaction with the gaseous target material, the particle beam incident at the charge exchange cell further including molecules and/or molecular ions which interact with the gaseous target material to reduce the concentration of molecules as a result of repeated collisions with particles of the gaseous target material thereby to provide a treated particle beam.

In a second preferred aspect, the present invention provides a method for performing mass spectrometry on an analyte sample including the steps of:

- generating a particle beam using the analyte sample, the particle beam including positive ions;
- passing the particle beam through a charge exchange cell according to the first aspect thereby to provide a treated particle beam containing negative ions; and
- passing the treated particle beam to a particle detector configured to detect at least some of said negative ions.

In a third preferred aspect, the present invention provides a mass spectrometry system suitable for performing mass spectrometry on an analyte sample, the system including:

- a particle beam generator for generating a particle beam using the analyte sample, the particle beam including positive ions;
- a charge exchange cell, the charge exchange cell configurable to contain a gaseous target material, the target material being a material that is electrically insulating at room temperature and pressure, the charge exchange cell being operable so that at least some of the positive ions of the particle beam are converted to negative ions by interaction with the gaseous target material thereby to provide a treated particle beam; and
- a particle detector configured to detect at least some of said negative ions in said treated particle beam.

The use in the charge exchange cell of a gas that is gaseous at about room temperature and atmospheric pressure is convenient because it allows the metering and manipulation of the gas using conventional gas handling equipment. In turn, this allows for precise control of the concentration and pressure of gas in the charge exchange cell. This also allows the use of precisely controlled mixtures of gases.

The expression "gaseous target material" is used interchangeably in this disclosure with "target gas".

The gas employed in the charge exchange cell is of material that is electrically insulating at room temperature and pressure. The target material may not necessary be a gas at room temperature and pressure, but should be electrically insulating at room temperature and pressure irrespective of state. This is in contrast to known charge exchange cell gases which are typically metal vapours, which must be maintained at high temperature to remain in the gaseous state and so cannot be considered to be of materials that are electrically insulating at room temperature and pressure, under which conditions they would be condensed and electrically conductive. As indicated above, the generation and control of metal vapours is cumbersome and difficult. Furthermore, the use of high electric fields in mass spectrometry means that metal vapours must be carefully contained in order to avoid compromising the operation of the mass spectrometry system.

The first, second and/or third aspect of the invention may be combined with each other in any combination. Furthermore, they may have any one or, to the extent that they are compatible, any combination of the following optional features.

The gas used in the charge exchange cell preferably includes at least one of hydrogen, helium, nitrogen, argon, methane, ethane, propane, butane, isobutane, other hydrocarbons, or a mixture of two or more of these components. The inventors consider that these gases provide a suitable combination of ability to donate electrons to the positive ions in the ion beam and ability to destroy molecular interference. This relates particularly (but not exclusively) to the operation of the invention in the detection of $^{14}C$.

It is also preferable that the target gas is energetically-pumped. This may be achieved using electromagnetic energy. It can be particularly suitable to pump the target gas using an RF or microwave signal. By energetically pumping the gas, the number of free electrons is increased (i.e. a full or partial plasma can be generated). As a result, the electron donation ability of the gas increases, and so it may be more effective as a negative-ion generator.

The particle beam incident at the charge exchange cell includes molecules and/or molecular ions which interact with the target gas to reduce the concentration of molecules within the treated particle beam. The reduction in concentration occurs as a result of repeated collisions with gas atoms/molecules in the charge exchange cell. In order to effect efficient molecular suppression, the target gas should be sufficiently thick. In order to traverse the target gas, the incident ions in the particle beam should preferably have energies of at least 10 keV, more preferably at least 20 keV, more preferably at least 30 keV, more preferably at least 40 keV, more preferably at least 50 keV, more preferably at least 60 keV, more preferably at least 70 keV, more preferably at least 80 keV, more preferably at least 90 keV, and more preferably at least 100 keV. At these energies, the present inventors consider that non-metallic, electrically insulating gases are similarly efficient to metallic vapours but Hotchkis and Wei (2007), for example, failed to show that metallic vapours can act as both a good source of electrons and a good suppressor of molecules. Due to the benefits discussed above, insulating gases are therefore highly advantageous.

Preferably, the target gas includes a mixture of gases. The amounts of each component in the target gas are preferably selected to favour the transmission of a particular particle species in the incident particle beam, while suppressing the transmission of others. For example, when it is desirable to transmit atomic carbon ions without prohibitively scattering them, but it is also desirable to eliminate hydrocarbon molecules from the treated beam, then size-matched nitrogen gas can be used or size-matched carbon atoms in gases of more complex molecules. Isobutane or propane can also be used, since these are highly electropositive, to promote the formation of negative carbon ions.

Thus, preferably, the target gas preferably includes a component that is matched in terms of atomic weight to the species in the particle beam which it is intended to detect. A suitable or best match is established empirically but not being restricted to metals provides many more options for optimisation.

Using the present invention, it is possible to adjust the components and/or concentration of the target gas in the charge exchange cell. This can be done readily and precisely using known mass flow gas controllers, for example. The required target gas formulation can be adjusted based on the detected negative ions and associated measurements. For example, in the case of $^{14}C$ measurement, the formulation of the target gas can be adjusted while monitoring the measured $^{14}C$, stable carbon isotopes and their ratio. The optimum target gas thickness is the one which maximizes both the molecule suppression and charge exchange. Preferably, the composition and/or amount of gas in the charge exchange cell can be adjusted automatically using a feedback loop.

Preferably, the incident particle beam is at least partially filtered before reaching the charge exchange cell. Unwanted constituents in the incident particle beam can thereby be removed. This facilitates the subsequent utilisation of the remaining species including their identification and/or quantification. For example, when used in radiocarbon detection, it is preferable that the incident beam constituents include at least one of $^{14}C^{+}$, $^{14}C^{2+}$, $^{14}C^{3+}$. This is controlled by the ion source. Certain ion sources, as set out later, are advantageous in that they can play a role in suppressing interfering species.

However, usually interfering species will be present in the particle beam generated from the ion source. Filtration of the particle beam before arrival at the charge exchange call can remove at least some species. Preferably, the incident particle beam is filtered so that it consists primarily of $^{14}C^{2+}$. This is considered to provide technical advantages over selection of $^{14}C^{1+}$ or $^{14}C^{3+}$. Selection of the 1+ charge-state is considered to produce super-natural measurement background, and selection of 3+ charge-state ions is more challenging, since they are more difficult to produce, require higher energy ion sources and in any event are less abundantly produced and so provide a low signal. This filtering is preferably carried out using a first mass spectrometer between the ion source and the charge exchange cell. However it should be noted that this filtering step is not considered essential. Further filtering of the particle beam, for example to filter out undesirable negative ion species (for example, leaving substantially only $^{14}C^{-}$), is preferably carried out after the beam leaves the charge exchange cell, and before the beam reaches the detector.

The positive ions in the particle beam are preferably generated using an electron cyclotron resonance (ECR) ion source. Plasma ion sources such as ECR ion sources can produce intense positive ion beams from gas samples as the ions are extracted from the sample volume, in contrast with AMS sputter ion source sample surface ionisation. ECR ion sources can readily achieve reliable operating conditions, and are more compatible with common analytical chemistry automated sample specification and preparation techniques. The plasma in the ECR ion source is preferably manipulated, for example by the addition of a carrier gas or by addition of excess sample material, in order that the ECR ion source operates to discriminate against the production of ions of some constituents. For example, a helium carrier gas can suppress the production of hydrocarbon molecules which are potential interferences to carbon atomic ions in the case of a $CO_2$ sample.

Thus, it is preferred that following generation of the particle beam, a portion of the particle beam is selected using a first mass spectrometer, prior to reaching the charge exchange cell.

In the charge exchange cell, preferably the target gas suppresses at least one interfering species by repeated collision with the target gas.

Following the charge exchange cell, preferably the treated particle beam is further subjected to selection using a second mass spectrometer. Following this, preferably the selected part of the treated particle beam reaches the particle detector configured to detect at least some of said negative ions.

The present invention is considered to be particularly applicable to $^{14}C$ analysis, and therefore the following disclosure relates to this.

Preferably the particle beam is generated using the analyte sample inside an electron cyclotron resonance ion source operated to at least partially suppress the formation of molecules. Using such an ion source, the generated particle beam is preferably filtered to select the $^{14}C^{2+}$ portion, and remaining interferences using a first mass spectrometer.

The particle beam is then passed through a charge exchange cell. The charge exchange cell preferably contains sufficiently thick isobutane or similarly effective other gas to both convert positive incident $^{14}C$ ions to negative ions and to suppress $^{13}CH$ and $^{12}CH_2$ interferences, thereby providing the treated particle beam.

The treated particle beam is then preferably passed through a second mass spectrometer to select $^{14}C^{-}$. The selected portion of the treated particle beam is received at the particle detector to detect $^{14}C^{-}$.

Further optional features of the invention are set out below.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENT, AND FURTHER OPTIONAL FEATURES OF THE INVENTION

Figure 1:
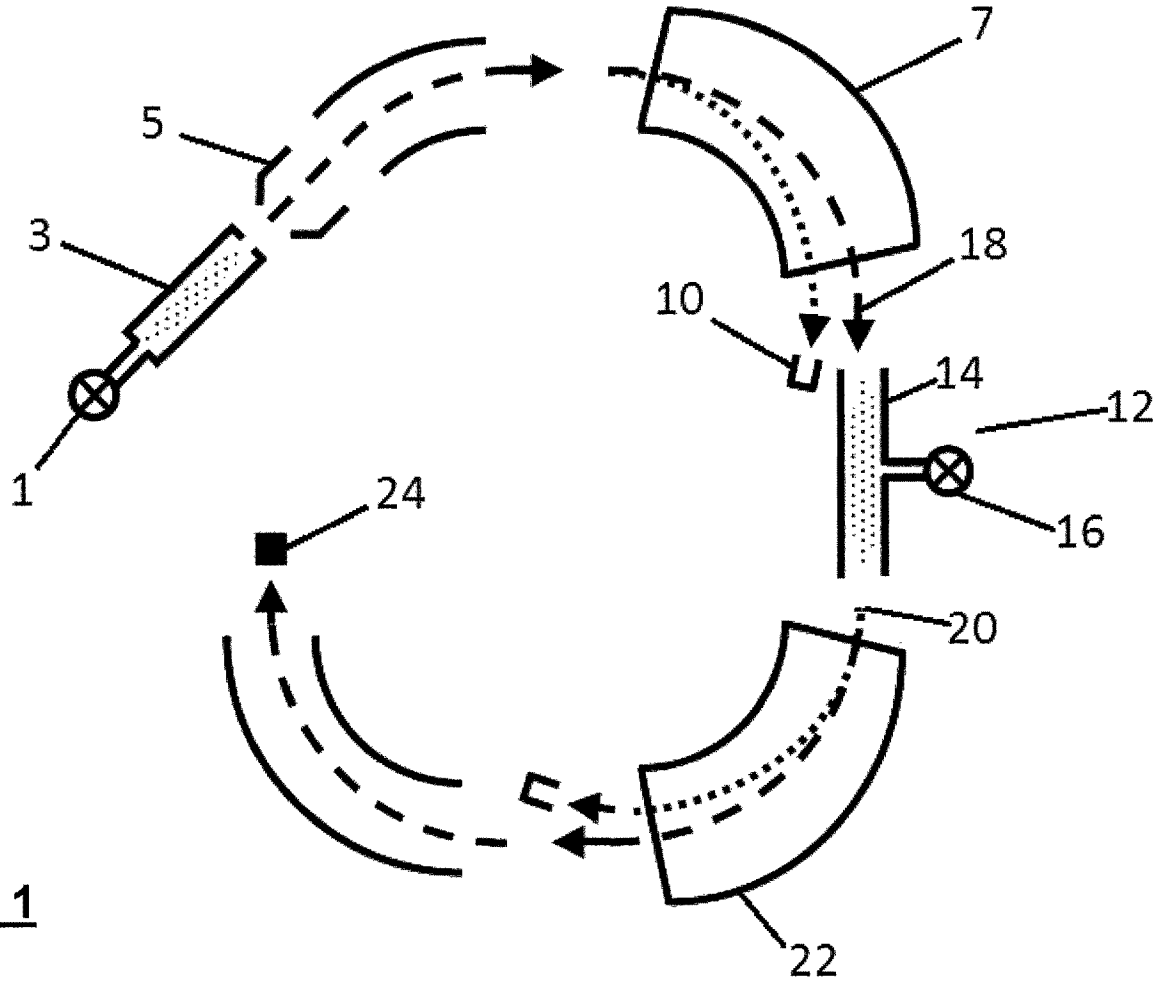
FIG. 1 shows a schematic of an embodiment of the present invention, used to measure radiocarbon.

FIG. 1 shows a schematic of radiocarbon measurement according to an embodiment of the invention. Beginning in the electron cyclotron resonance (ECR) ion source, interferences to $^{14}C$ detection are increasingly suppressed until reliable radiocarbon detection is possible. In FIG. 1, the two mass spectrometers each comprise an electrostatic spherical analyser (ESA) and dipole magnet. Component electrical-biasing is not shown but by manipulating the beam energy the carbon stable isotopes can be quantified with Faraday cup detectors.

The mass spectrometer components shown in FIG. 1 are given by way of example only. They may be differently ordered, added to or subtracted from, and other components such as ion velocity Wien-filters may be substituted.

As is the case of conventional AMS, the $^{14}C$ is measured in ratio to stable $^{12}C$ and/or $^{13}C$ in the common beam from the ion source. The first spectrometer separates the radiocarbon from stable carbon ions which can then be measured as an electric current in a dedicated Faraday cup detector. The stable ions can be made to also pass through the charge-exchange cell and so also be measured free of hydrocarbon interference in dedicated Faraday cups after the second mass spectrometer by temporarily adjusting the ion energy of beam from the ion source so that the stable nuclides achieve the same rigidity as the radiocarbon ions and transmit the first mass spectrometer. The whole system is calibrated by separate measurements of the isotope ratios produced with standard sample materials of known carbon isotope ratios. Accordingly the production of ions in the ion source or in the charge-exchange cell need not be quantitative, but should preferably be consistent. Nevertheless high efficiency in these processes is desirable for expeditious sample measurement or low minimum sample size.

Figure 2:
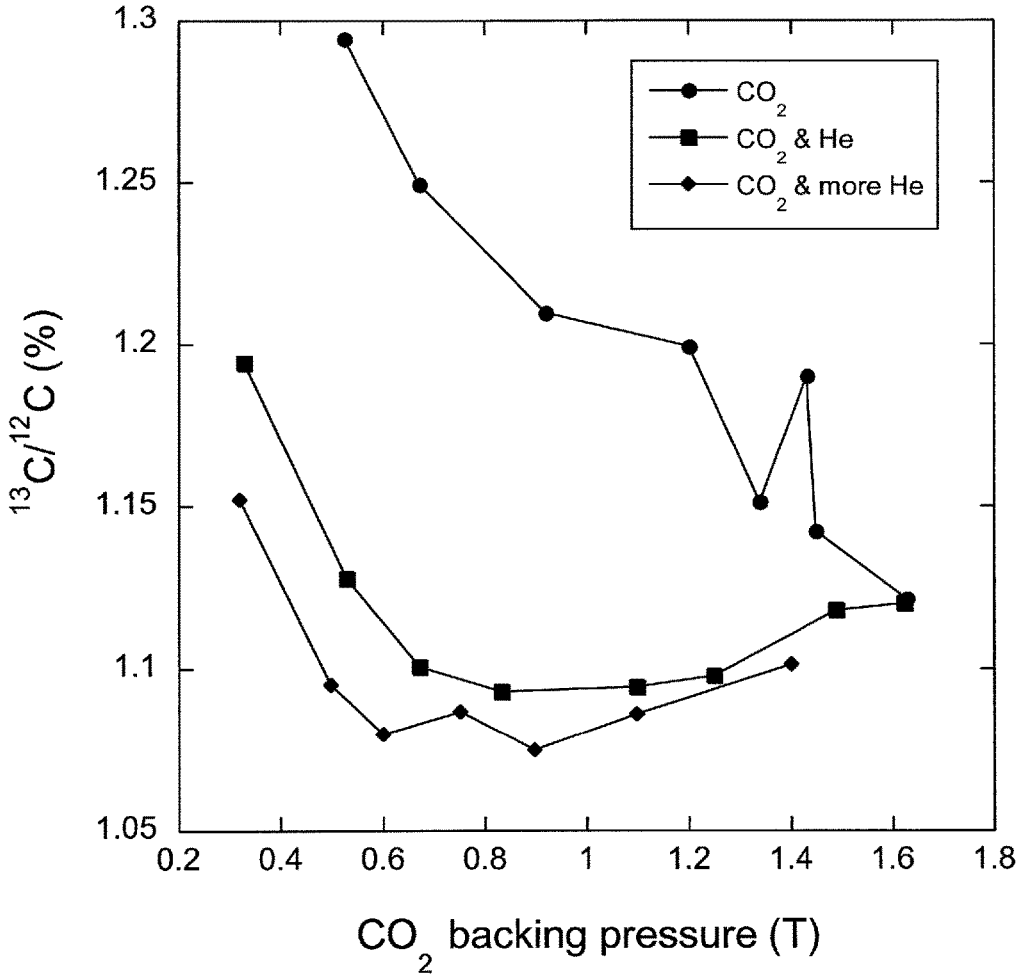
FIG. 2 shows a graph showing the isotope ratios achieved by different sample gas compositions and pressures.

FIG. 2 demonstrates ion source molecule suppression using stable isotopes. Positive carbon ion beams are extracted from a Pantechnik S. A. Nangon 10 GHz ECR plasma ion source newly mounted (at the time of writing) on an ion source deck of the Scottish Universities Environmental Research Centre (SUERC) bi-polar single-stage accelerator mass spectrometer (SSAMS) (Freeman et al (2008) and Freeman et al (2010)). The SUERC SSAMS is intended for routine conventional radiocarbon AMS but can also undertake positive-ion experimentation (Wilcken at al (2008)). This requires the reversal of some electrical and magnetic polarities but otherwise the spectrometer, including ion optical elements, ion detectors, data system and supporting vacuum and cooling systems, is operated similarly in either polarity. Existing sputter ion source control signals are co-opted to run the plasma ion source and the sample gas is delivered by an existing gas-handling system (Xu et al (2007)).

The graph of FIG. 2 is of the $^{13}C^{+}/^{12}C^{+}$ ratio obtained from the first mass spectrometer (see FIG. 1) where $^{12}CH$ interferes with $^{13}C$. It is evident that the measured $^{13}C/^{12}C$ ratio can be reduced by increasing $CO_2$ sample gas in the ion source or else by adding He carrier to increasingly remove $^{12}CH$ from the ion beam until the expected $^{13}C/^{12}C$ ratio is reached. The same effect is employed for $^{14}C$ measurement in the preferred embodiment of the present invention.

The preferred embodiment of the invention for sample radiocarbon measurement suppresses interference to $^{14}C$ detection in steps:

Step 1: Partial hydrocarbon molecule suppression in an ECR ion source producing positive carbon ions in a variety of charge states from $CO_2$ sample, optionally in the presence of He carrier gas.

Step 2: Partial hydrocarbon molecule suppression by the selection of the $^{14}C^{2+}$ with a first mass spectrometer.

Step 3: Suitable additional hydrocarbon molecule suppression and $^{14}N$ atomic isobar suppression with a thick non-metallic gas charge-exchange cell.

Step 4: Resulting $^{14}C^{-}$ separation from molecular-fragments and remaining positive ions in the treated particle beam (exiting the charge-exchange cell) using a second mass spectrometer.

Step 5: $^{14}C^{-}$ ion detection and counting with a final particle detector.

The inventors observe that selecting the 2+ charge state partially suppresses molecular interference. It is considered that using this charge state for measuring natural-abundance $^{14}C$ has not been disclosed previously. 1+ selection produces super-natural $^{14}C$ measurement background at SUERC, whereas the selection of less-copious 3+ or even more highly charged positive ions is unnecessary.

Figure 3:
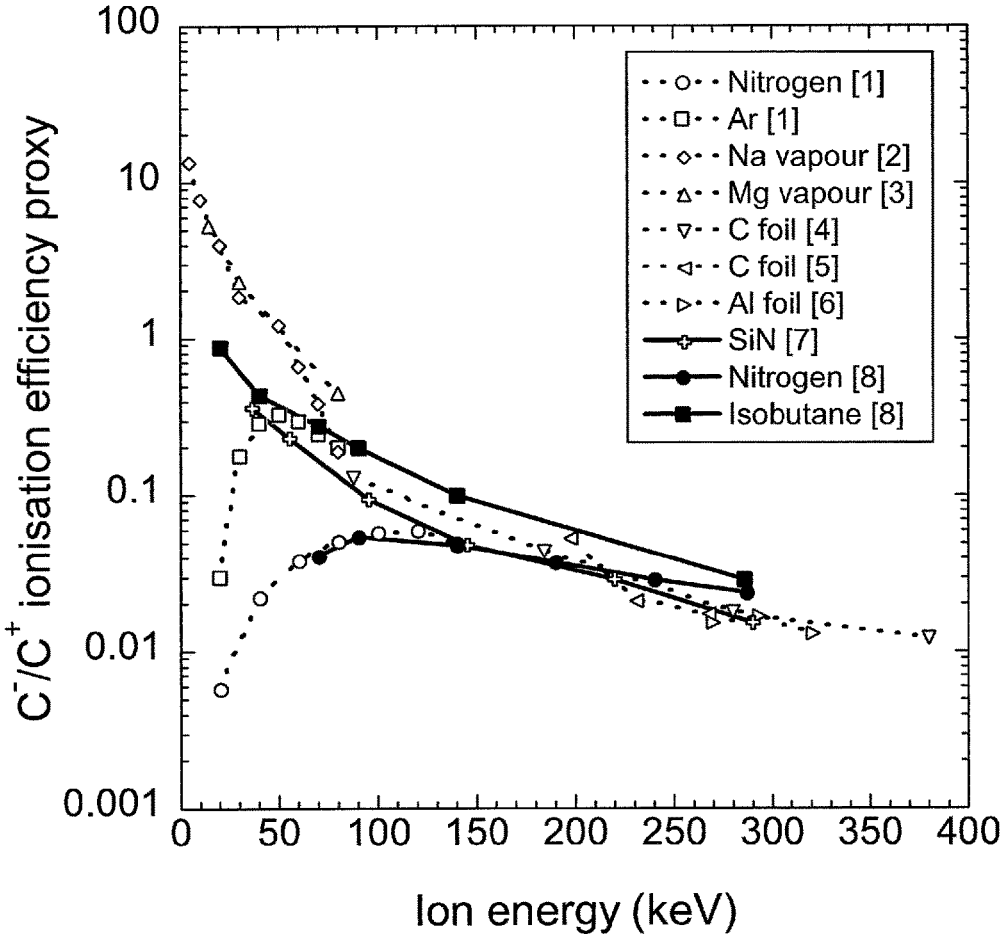
FIG. 3 shows the ratio of negative to positive ions exiting the charge exchange cell for different charge exchange media.

FIG. 3 shows why thick non-metal charge-exchange gas is employed to both remove remaining molecules and suppress $^{14}N$ by ion charge inversion. FIG. 3 shows the ratio of C− to C+ ions exiting the SUERC SSAMS charge-exchange cell with various non-metallic gases measured with the instrument second mass spectrometer, using incident C2+ ions of the stable isotope noted. The SiN [7] data is from Wilcken et al. (2013) and the other dashed curves [1]-[6] from the references cited therein for comparison.

Tenuous metal vapours are known as efficient means of charge-exchanging positive ions negative at low ion energy. However, molecule suppression requires sufficiently thick gas and therefore incident ion energies of 10 s keV or more to traverse the gas and be quantifiable with a mass spectrometer. At these energies non-metallic gases are considered to be similarly efficient. Also, such gases can be readily manipulated with conventional gas-handling equipment (mass-flow controllers, etc.), whereas metal-vapour control is more cumbersome and imprecise, and electrically-insulating gas cannot compromise the electric fields employed in mass spectrometry in a way that leaking metal vapour can. Moreover, a gas or gas blend can be chosen to provide the optimal combination of molecule suppression without excessive beam scattering and negative-ionisation.

The gas requirements for good molecule suppression are the same as conventional AMS utilising thick stripper. Accordingly we can employ the same $N_2$ gas metered into the same differentially-pumped open-ended tube between the mass spectrometers of the SSAMS as when the instrument is functioning conventionally. In that case this serves as the 'stripper'-canal, whereas in the positive-ion method this serves as an electron-'adder'. Gases other than pure $N_2$ are conjectured to be the optimum, for example propane or isobutane. More electropositive gases such as isobutane are more efficient at donating electrons as shown in FIG. 3. The amount of gas employed is found empirically by adjusting gas flow whilst monitoring the measured $^{14}C$ and stable carbon isotopes and their ratio. Gas thickness is an acceptable compromise of that best for molecule-removing and for charge-exchanging, and in a further improved embodiment can be adjusted automatically in feedback depending on the abundance of individual sample $^{14}C$ and interferences.

The beam energy is determined by the electrical biasing of the ion source and the charge-exchange cell deck. By the method of the present invention, and with radiocarbon-'dead' $CO_2$ sample, radiocarbon measurement background of about 2% Modern (after correction for PIPS detector dark count) with 280 keV 14C ions has been achieved, chosen to match the ion energy employed when the SSAMS is operating conventionally, and good results also achieved at 140 keV, half this ion energy. This indicates that accelerator-free analysis is also possible in some embodiments in which ion source bias alone is sufficient.

Figure 4:
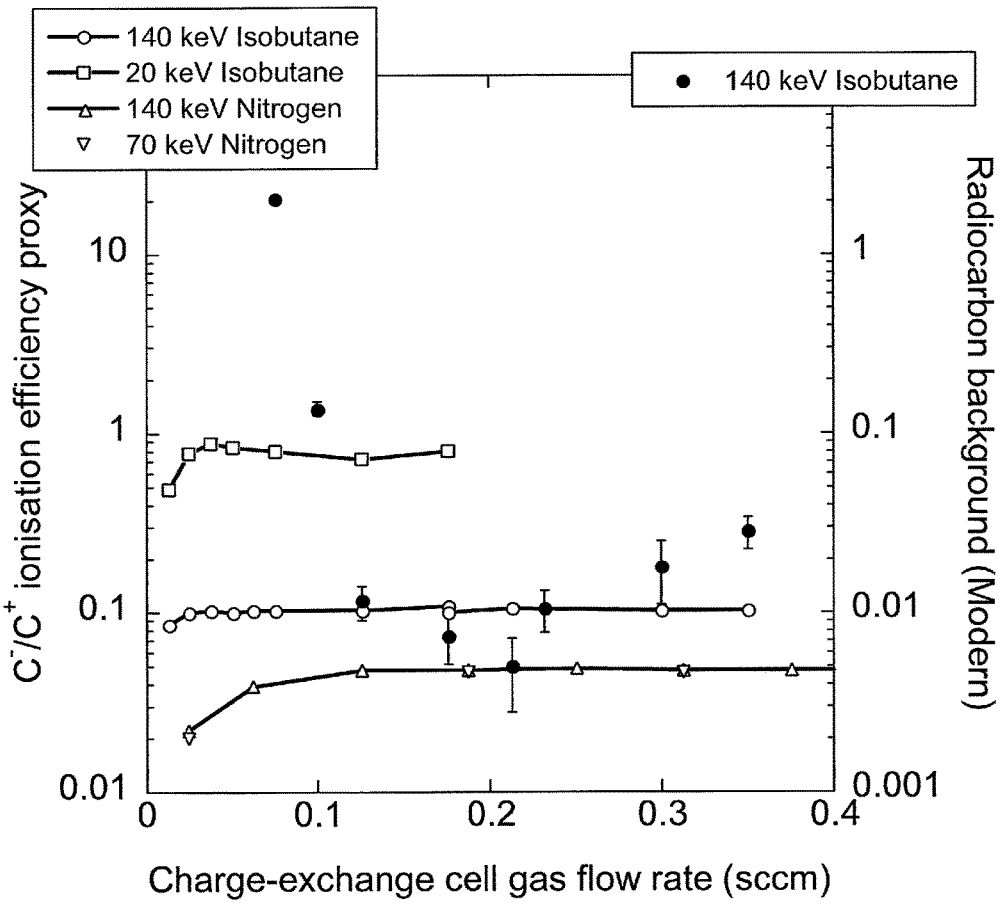
FIG. 4 shows the ratio of negative to positive ions exiting the charge exchange cell for different charge exchange media. The right hand axis shows the variation in background measurements with charge exchange cell gas flow rate.

FIG. 4 shows the variation in $C^-/C^+$ ratio for multiple gas flow rates. It shows that negative ionisation efficiency is constant once there is gas flow sufficient for charge state equilibrium. The level of ionisation efficiency is dependent on the charge exchange gas used, as well as the ion energy. Radiocarbon background measurements with isobutane gas are also shown in FIG. 4. The background measurements were observed to be lowest where the gas flow was sufficient to destroy molecules without significantly scattering ions into the detector.

Accordingly the described embodiment of the present invention is capable of reproducing the $^{14}C$ abundance measurement range of the conventional AMS technique. This is done with an ion source superior to the sputter negative-ion sources normally used. By virtue of leveraged higher initial ion charge in the ion source biasing electric field, the new method is also a better route to accelerator-less $^{14}C$ mass spectrometry than conventional AMS with potential considerable equipment cost savings.

Additional details and explanations of the preferred embodiment and modifications of the preferred embodiment will now be set out.

Particle Beam Source

The positively charged particle beam is generated in an ion source such as electron cyclotron resonance (ECR), inductively couple plasma (ICP) or a capacitively coupled plasmas (CCP) ion source. An ECR ion source is the presently preferred ion source. It has the advantage over ICP and CCP in that it can readily make higher charge states than the 1+ and so is better at eliminating molecular interferences.

Different charge states of the particle beam can be utilised from the ion source. Higher charge states, such as 3+ and above, have the advantage of being molecular free however they are more difficult to produce and therefore result in smaller beams (i.e. beams with fewer particles) and make less efficient use of the sample being measured.

Going down in charge state to the 2+ and then 1+, the molecular interfering content increases but bigger and more efficiently produced beams are possible. In any charge state it is also possible to optimise the source conditions to reduce molecules, such as using an additional carrier gas such as He in the source (see FIG. 2). As explained above, the preferred embodiment uses the partial molecular suppression provided by the 2+ charge state which provides sufficient beam for accurate measurements.

Sample Input

Samples can be inputted into the ion source in solid, liquid or gas form. Sample loading can be automated. Samples can be pre-treated and prepared separately from the system or they can be taken directly from another system, such as in the example of carbon, $CO_2$ can be combusted automatically from an organic source or generated in an elemental analyser and feed directly into the ion source. This has the advantage over conventional Cs sputter ion sources that typically only use samples prepared separately from the machine increasing labour and costs. In the case of carbon, the sample can comprise $CO_2$ prepared separately.

Ion Beam Analysis

The system of the preferred embodiment is a high-resolution mass spectrometer. It utilises the different bending radius for charged particles with different momentum to identify the mass of the particles. An electrostatic analyser (ESA) and magnet work together to select mass, the magnet selects a momentum (i.e. species with the same mass*velocity combination) and the ESA selects the same energy regardless of mass. These steps are standard in mass spectroscopy.

Interferences in this system are from particles with the same mass such as molecules or isobars. There is already at least partial molecular suppression in the ion source. The positive particle beam is then passed through the target gas in the charge exchange cell where the particles collide with the particles in the gas breaking apart the molecules. Ideally the target gas particles have a similar mass to the particle beam, i.e. heavy enough to create a strong collision and break the molecules apart without scattering the beam and destroying beam quality. The mass of the target gas is preferable to be similar to that of the ion beam for best performance, but it will work with other gases, but at potentially reduced performance. This removes the remaining molecular interferences.

As the particle beam passes through and collides with the gas, it exchanges electrons with the gas, such that some of the particles in the beam will pick up additional electrons and become negatively charged.

The charge exchange process works more efficiently when the target gas has low electronegativity. Metal vapours have low electronegativity, but are disadvantageous for the reasons already discussed. Of greater importance in the present invention is that the target gas is (or components of the target gas are) simple to flow in to the system. A metal vapour gas is difficult to maintain and it must be kept at a high temperature at all times to stop it condensing back into a liquid or solid. If metal gas vapour moves or migrates out of the charge exchange cell it can condense on insulators in the apparatus causing them to conduct and leading to potential electrical discharges. Using a gas which will not condense in use keeps the system cleaner and makes the system considerably simpler and cheaper to build. It is preferable that the gas has as low an electronegativity as possible but a high electronegativity may be acceptable provided that the loss in efficiency is acceptable.

In some cases, the isobar of the particle of interest cannot create a negative beam. Some such cases are:

$^{14}N$ will not produce a negative beam to interfere with $^{14}C$, to measure its content in bulk carbon.

Magnesium will not produce a negative beam to interfere with $^{26}Al$, to measure its content in bulk aluminium.

Xenon will not produce a negative beam to interfere with $^{129}I$, to measure its content in bulk iodine.

Manganese will not produce a negative beam to interfere with $^{55}Fe$, to measure its content in bulk iron.

The target gas can be excited or pumped to improve performance. In the simplest case a DC bias can be applied longitudinally to the gas, this will act to accelerate electron which are liberated in a collision between the particle beam and the gas, the accelerated electrons will then interact further with the gas and, if the energy is sufficient, liberate more electrons and/or velocity match with particle beam and promote recombination and negative ion formation. Where the DC voltage and gas pressure is sufficiently high then a cascade effect of the secondary ions will produce a plasma DC discharge. Additional methods of creating a full plasma is to pump the gas with an alternating electro-magnetic field such as RF in a CCP or ICP or microwaves in other plasmas such as the ECR ion source. In this case the low mass electrons are accelerated quickly in the alternating field whereas the ion is too heavy to respond and will remain relatively stationary (this is the typical description of an AC plasma). As the particle beam passes through the plasma these fast moving oscillating electrons energetically collide multiple times with the particle beam causing improved ionisation and molecular dissociation and, in the case of plasma, donate electrons to the ion beam producing the negative ions where the plasma cools or de-excites again.

System Description

FIG. 1 is now described in more detail. This refers to carbon measurement, but the system can be adapted to apply to the other isotopes discussed above.

$CO_2$ gas 1 is added to the ECR ion source 3 where it is ionised, molecules are at least in part broken up and a particle beam 5 is accelerated out of the ion source.

A dipole magnet 7 is used to select, for example, the 2+ carbon atoms for further analysis. The abundant isotopes, $^{12}C$ and $^{13}C$, are measured in off-axis Faraday cups 10 (the axis of the rare isotope being on-axis), whereas the rare isotope, $^{14}C$, is selected for further processing to remove the interferences of molecules such as $^{13}CH^{2+}$, and its isobar $^{14}N^{2+}$.

A fast switching DC bias can be applied to the first magnet vacuum manifold to alter the energy and therefore momentum of the abundant isotope to allow it to be switched on-axis, in this instance the off-axis cups to measure the abundant isotope is situated after the second magnet.

A gas cell 12, consisting of a tube 14 where a small amount of gas is flowed in through a mass flow controller 16 or other needle valve, flows down the tube and removed by differential pumping at either end. The on-axis isotope beam 18 passes through the tube where it interacts with the gas, significantly destroying the remaining molecules and charge exchanging so that the beam exiting the gas cell 20 has negligible molecules and a range of charge states for example, 20% in 1−, 50% neutral and 30% in 1+. All nitrogen is neutral or positively charged.

An ESA and dipole magnet 22 (in any order) are then used to select the $^{14}C^{1-}$ particles, which are now free from any molecules or isobars, and send them to a single particle detector 24.

Another variation on the system is to remove the first selection magnet and pass everything through the clean-up stage in the gas cell, in which case the $^{12}C$, $^{13}C$ and $^{14}C$ are all measured in the 1− charge state after the magnet.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above and in the lists below are hereby incorporated by reference.

LIST OF REFERENCES APPEARING IN FIG. 3

The reference numbers in square brackets below are references for the data points used in FIG. 3 and are distinct from other reference numbers not in square brackets used elsewhere in the application.

[1] J. H. Ormrod, W. L. Michel, Can. J. Phys. 49 (1971) 606-620

[2] J. Heinemeier, P. Hvelplund, Nucl. Instr. Meth. 148 (1978) 425-429

[3] J. Heinemeier, P. Hvelplund, Nucl. Instr. Meth. 148 (1978) 65-75

[4] B. Christensen et al, Phys. Rev. A 18 (1978) 2042-2046

[5] W. N. Lennard et al, Nucl. Instr. Meth. 179 (1981) 413-419

[6] W. N. Lennard et al, Rhys. Rev. A 24 (1981) 2809-2813

[7] K. M. Wilcken et al, Nucl. Instr. Meth. B 294 (2013) 353-355

[8] S. P. H. T. Freeman et al, Nucl. Instr. Meth. B (2015) http://dx.doi.org/10.1016/j.nimb.2015.04.034

LIST OF NON-PATENT DOCUMENT REFERENCES

Hans-Arno Synal, *Developments in accelerator mass spectrometry*, International Journal of Mass Spectrometry 349-350 (2013) 192-202

Walter Kutschera, *Applications of accelerator mass spectrometry*, International Journal of Mass Spectrometry 349-350 (2013) 203-218

Stewart P. H. T. Freeman, Andrew Dougans, Lanny McHargue, Klaus M. Wilcken, Sheng Xu, *Performance of the new single stage accelerator mass spectrometer at the SUERC*, Nuclear Instruments and Methods in Physics Research B 266 (2008) 2225-2228

Stewart P. H. T. Freeman, Gordon T. Cook, Andrew B. Dougans, Philip Naysmith, Klaus M. Wilcken, Sheng Xu, *Improved SSAMS performance*, Nuclear Instruments and Methods in Physics Research B 268 (2010) 715-717

K. M. Wilcken, S. P. H. T. Freeman, S. Xu, A. Dougans, *Positive ion AMS with a single-stage accelerator and an RF-plasma ion source at SUERC*, Nuclear Instruments and Methods in Physics Research B 266 (2008) 2229-2232

Sheng Xu, Andrew Dougan, Stewart P. H. T. Freeman, Colin Maden, Roger Loger, *A gas ion source for radiocarbon measurement at SUERC*, Nuclear Instruments and Methods in Physics Research B 259 (2007) 76-82

Roy Middleton, *On the possibility of counting $^{14}C^{-}$ ions without an accelerator*, Proceedings of the First Conference on Radiocarbon Dating with Accelerators held at The University of Rochester Apr. 20 and 21, 1978 Edited by H. E. Gove, 157-164

Ronald Schubank, *A low-energy table-top approach to AMS*, Nuclear Instruments and Methods in Physics Research B 172 (2000) 288-292

Michael Hotchkis, Tao Wei, *Radiocarbon detection by ion charge exchange mass spectrometry*, Nuclear Instruments and Methods in Physics Research B 259 (2007) 158-164

F. W. Meyer, E. Galutschek, M. Hotchkis, *Low-energy grazing ion-scattering from Alkali-Halide surfaces: a novel approach to C-14 detection*, AIP Conf. Proc. 1099 (2009) 308-313

M. L. Robert, R. J. Schneider, K. F. von Reden, J. S. C. Wills, B. X. Han, J. M. Hayes, B. E. Rosenheim, W. J. Jenkins, *Progress on a gas-accepting ion source for continuous-flow accelerator mass spectrometry*, Nuclear Instruments and Methods in Physics Research B 259 (2007) 83-87

K. M. Wilcken, S. P. H. T. Freeman, S. Xu, A. Dougans, *Attempted positive ion radiocarbon AMS*, Nuclear Instruments and Methods in Physics Research B 268 (2010) 712-714

K. M. Wilcken, S. P. H. T. Freeman, S. Xu, A. Dougans, *Single-stage accelerator mass spectrometer radiocarbon-interference identification and positive-ionisation characterisation*, Nuclear Instruments and Methods in Physics Research B 294 (2013) 353-355

The invention claimed is:

1. A method of treating a particle beam, the particle beam including positive ions, including the step of passing the particle beam through a charge exchange cell, the charge exchange cell containing a gaseous target material, the gaseous target material being a material that is electrically insulating at room temperature and pressure, at least some of the positive ions of the particle beam being converted to negative ions by interaction with the gaseous target material, the particle beam incident at the charge exchange cell further including molecules and/or molecular ions which interact with the same gaseous target material in the same charge exchange cell to reduce the concentration of molecules as a result of repeated collisions with particles of the gaseous target material thereby to provide a treated particle beam, wherein the negative ions are selected from the treated particle beam for subsequent analysis.

2. The method according to claim 1 wherein the gaseous target material includes a component that is matched in terms of atomic weight to a species in the particle beam to be detected.

3. The method according to claim 1 wherein the gaseous target material used in the charge exchange cell includes at least one of hydrogen, helium, nitrogen, argon, methane, butane, ethane, isobutane and propane, or a mixture thereof.

4. The method according to claim 1 wherein the gaseous target material is energetically-pumped.

5. A method for performing mass spectrometry on an analyte sample including the steps of:

generating a particle beam using the analyte sample, the particle beam including positive ions;

passing the particle beam through a charge exchange cell, the charge exchange cell containing a gaseous target material, the gaseous target material being a material that is electrically insulating at room temperature and pressure, at least some of the positive ions of the particle beam being converted to negative ions by interaction with the gaseous target material, the particle beam incident at the charge exchange cell further including molecules and/or molecular ions which interact with the same gaseous target material in the same charge exchange cell to reduce the concentration of molecules as a result of repeated collisions with particles of the gaseous target material thereby to provide a treated particle beam; and passing the treated particle beam to a particle detector configured to detect at least some of said negative ions.

6. The method according to claim 5 used for radiocarbon detection, wherein the beam generated from the analyte sample includes at least one of $^{14}C^{+}$, $^{14}C^{2+}$, and $^{14}C^{3+}$.

7. The method according to claim 6 wherein the treated particle beam is passed through a mass spectrometer to select $^{14}C^{-}$, and receiving the selected portion of the beam at the particle detector configured to detect $^{14}C^{-}$.

8. The method according to claim 5 wherein the incident particle beam is subjected to selection using a first mass spectrometer before reaching the charge exchange cell.

9. The method according to claim 8 wherein the incident particle beam is subjected to selection so that it consists primarily of $^{14}C^{2+}$ and incidental interferences.

10. The method according to claim 6 wherein the positive ions in the particle beam are generated using an electron cyclotron resonance (ECR) ion source.

11. The method according to claim 10 wherein the plasma in the ECR ion source is manipulated by the addition of a carrier or by addition of excess sample material, in order that the ECR ion source operates to discriminate against the production of ions of some constituents.

12. The method according to claim 11 wherein a helium carrier gas is added to suppress the production of hydrocarbon molecules where the sample is a $CO_2$ sample.

13. The method according to claim 6 wherein, in the charge exchange cell, the gaseous target material suppresses at least one interfering species by repeated collision with the gaseous target material.

14. The method according to claim 8 wherein, following the charge exchange cell, the treated particle beam is further subjected to selection using a second mass spectrometer.

15. The method according to claim 14 wherein the selected part of the treated particle beam reaches the particle detector configured to detect at least some of said negative ions.

16. A method for performing mass spectrometry on a carbon-based analyte sample including the steps of:

generating a particle beam from the analyte sample using an electron cyclotron resonance ion source operated to generate $^{14}C^{2+}$;

selecting the $^{14}C^{2+}$ portion, and remaining interferences, using a first mass spectrometer;

passing the particle beam through a charge exchange cell containing a gaseous target material selected from a group comprising one or more of hydrogen, helium, nitrogen, argon, methane, butane, ethane, isobutene, propane, and a mixture thereof to convert positive incident $^{14}C$ ions to negative ions by interaction with the gaseous target material and to suppress $^{13}CH$ and $^{12}CH_2$ interferences as a result of repeated collisions with particles of the gaseous target material in the same charge exchange cell thereby to provide a treated particle beam containing negative ions;

passing the treated particle beam through a second mass spectrometer to select $^{14}C^{-}$; and receiving the selected portion of the treated particle beam at the particle detector to detect $^{14}C^{-}$.

17. A mass spectrometry system suitable for performing mass spectrometry on an analyte sample, the system including:

a particle beam generator for generating a particle beam using the analyte sample, the particle beam including positive ions;

a charge exchange cell, the charge exchange cell configurable to contain a gaseous target material the gaseous target material being a material that is electrically insulating at room temperature and pressure, the charge exchange cell being operable so that at least some of the positive ions of the particle beam are converted to negative ions by interaction with the gaseous target material the charge exchange cell further being operable so that molecules and/or molecular ions present in the particle beam incident at the charge exchange cell interact with the same gaseous target material in the same charge exchange cell to reduce the concentration of molecules as a result of repeated collisions with particles of the gaseous target material, thereby to provide a treated particle beam; and a particle detector configured to detect at least some of said negative ions in said treated particle beam.

18. The mass spectrometry system according to claim 17 including mass flow gas controllers for controlling the gas formulation in the charge exchange cell at room temperature.

* * * * *